US006173472B1

(12) United States Patent
McLaughlin et al.

(10) Patent No.: US 6,173,472 B1
(45) Date of Patent: Jan. 16, 2001

(54) APPARATUS FOR REMOVING A LIQUID FROM A HARD SURFACE

(75) Inventors: Hugh Rogers McLaughlin; Oliver Hood, both of Dublin; John Callaghan, Naas, all of (IE)

(73) Assignee: Hugh R. McLaughlin, Dublin (IE)

( * ) Notice: Under 35 U.S.C. 154(b), the term of this patent shall be extended for 0 days.

(21) Appl. No.: 08/983,410

(22) PCT Filed: Jul. 19, 1996

(86) PCT No.: PCT/IE96/00043

§ 371 Date: Mar. 10, 1999

§ 102(e) Date: Mar. 10, 1999

(87) PCT Pub. No.: WO97/03599

PCT Pub. Date: Feb. 6, 1997

(30) Foreign Application Priority Data

Jul. 21, 1995 (IE) ..... S950557

(51) Int. Cl.[7] ..... A47L 13/58

(52) U.S. Cl. ..... 15/260; 15/257.06; 15/264; 15/230.11

(58) Field of Search ..... 15/116.2, 119.2, 15/230.11, 257.06, 260, 261, 262, 264

(56) References Cited

U.S. PATENT DOCUMENTS

| | | | | |
|---|---|---|---|---|
| 2,723,410 | * | 11/1955 | Sprung | 15/264 |
| 2,911,663 | * | 11/1959 | Geary | 15/260 |
| 3,916,470 | * | 11/1975 | May | 15/257.06 |
| 4,200,949 | * | 5/1980 | Heniff, Jr. | 15/257.06 |

FOREIGN PATENT DOCUMENTS

| | | | | |
|---|---|---|---|---|
| 45 527 | * | 2/1966 | (DE) | 15/257.06 |
| 112 401 | * | 2/1968 | (NO) | 15/257.06 |

* cited by examiner

*Primary Examiner*—Randall E. Chin
(74) *Attorney, Agent, or Firm*—Michael G. Petit

(57) ABSTRACT

An apparatus for removing a liquid from a hard surface comprising a roller unit including a roller rotatably mounted on a handle and covered with an absorbant sponge-like material, and a compression unit into which the roller of the roller unit may be inserted for removing water from the roller by compressing the absorbant material. The compression unit includes a surface along which the roller can be rolled and means engageable with the roller for pressing the roller against the surface to compress the absorbant material when the roller is rolled along the surface.

22 Claims, 5 Drawing Sheets

APPARATUS FOR REMOVING A LIQUID FROM A HARD SURFACE

BACKGROUND OF THE INVENTION

1. Field of the Invention

This invention relates to an apparatus for removing a liquid from a hard surface, for example for removing water, spilt oil or other liquids from floors, walls, car bodies, windows and other hard surfaces.

2. Prior Art

May, in U.S. Pat. No. 3,916,470, discloses an apparatus for removing liquid from a floor with a damp pad or cloth. The apparatus comprises a mopping roller enveloped by a mopping pad or a band-shaped mopping cloth which runs endlessly over rollers or from a first to a second spool, and bears on the working surface disposed underneath a mopping shoe or roller. The mopping roller and its enveloping mopping pad is intermittently advanced during the mopping process to bring a previously unused portion of the mopping pad into contact with the working surface at a preselected forward stroke.

Similar devices have been disclosed that are adapted to remove excess paint from a paint roller. Representative prior art devices are set forth in U.S. Pat. No. 4,200,949 to Heniff, Jr., U.S. Pat. No. 2,911,663 to Geary, U.S. Pat. No. 2,723, 410 to Sprung et al., and Norwegian patent 112401. While the above devices are useful for removing excess liquid from an applicator, they do not expel sufficient liquid from the applicator pad to be efficiently operable for removing a liquid from a hard surface.

SUMMARY

An apparatus for removing a liquid from a hard surface comprising a roller unit including a roller rotatably mounted on a handle and covered with an absorbant sponge-like material, and a compression unit into which the roller of the roller unit may be inserted for removing water from the roller by compressing the absorbant material. The compression unit includes a surface along which the roller can be rolled and means engageable with the roller for pressing the roller against the surface to compress the absorbant material when the roller is rolled along the surface.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1:
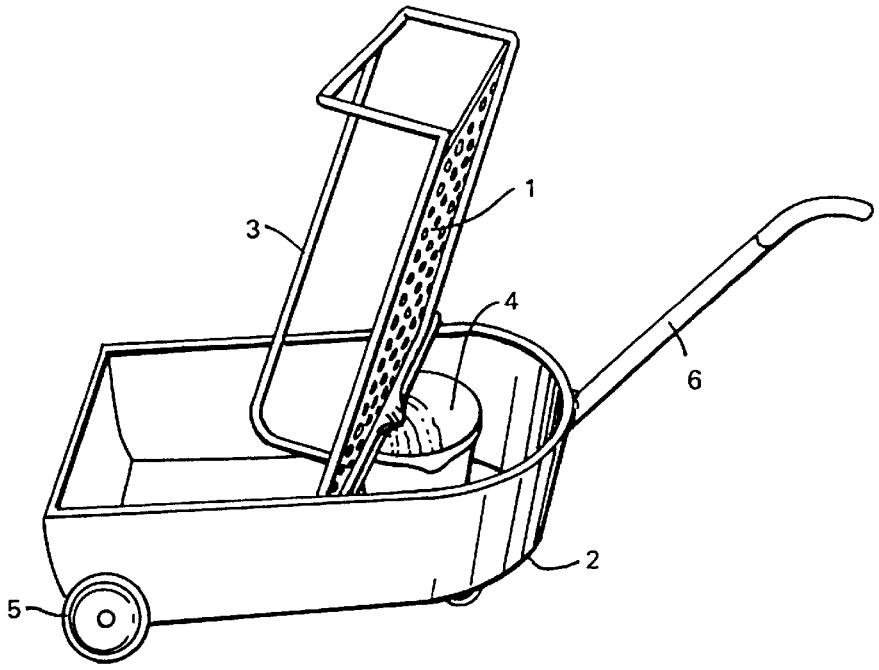
FIG. 1 is a perspective view of an apparatus for removing liquid from a hard surface according to a first embodiment of the invention.
Figure 2:
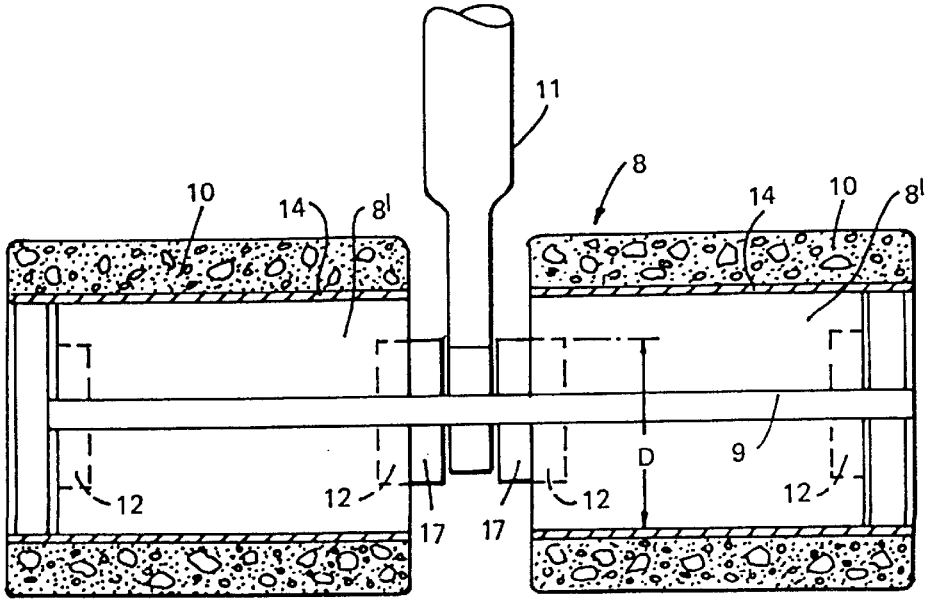
FIG. 2 is an axial cross-section of the roller unit of the apparatus of FIG. 1.
Figure 3:
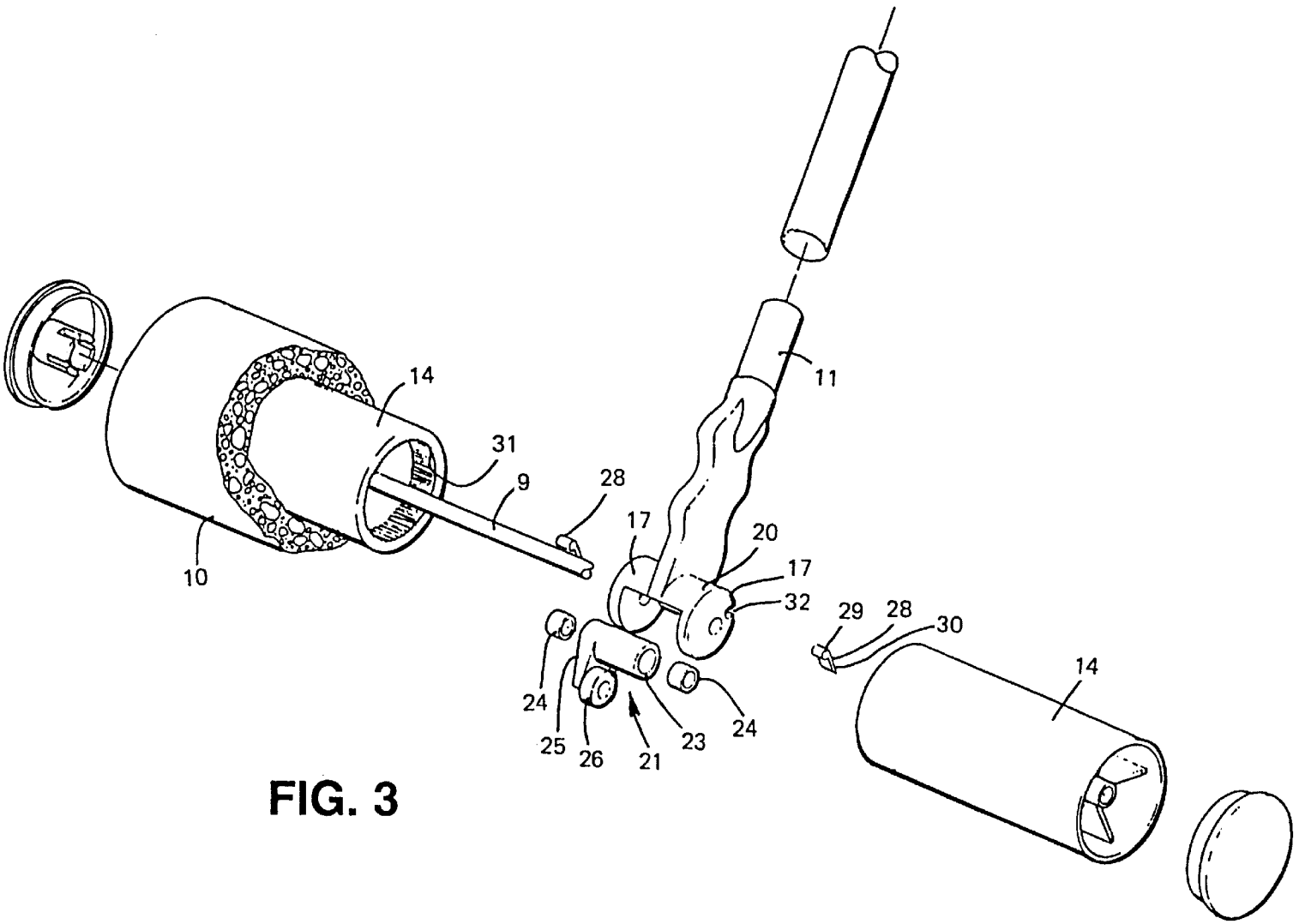
FIG. 3 is an exploded perspective view of a roller unit of an apparatus according to a second embodiment of the invention.
Figure 4:
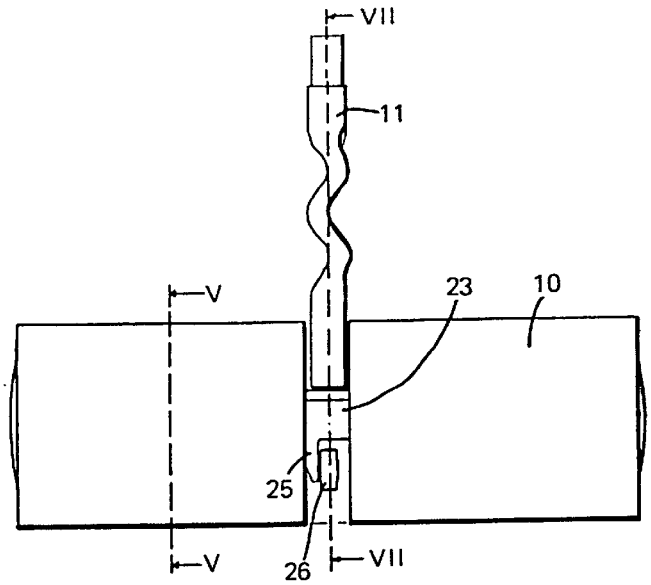
FIG. 4 is a front view of the roller unit of FIG. 3.
Figure 5:
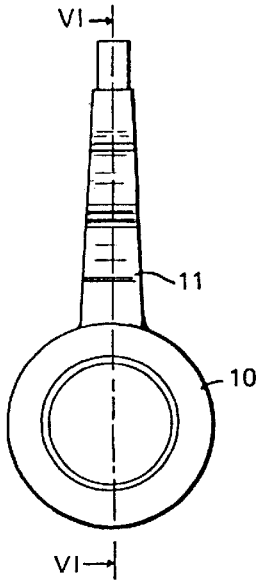
FIG. 5 is an end view of the roller unit of FIG. 3.
Figure 6:
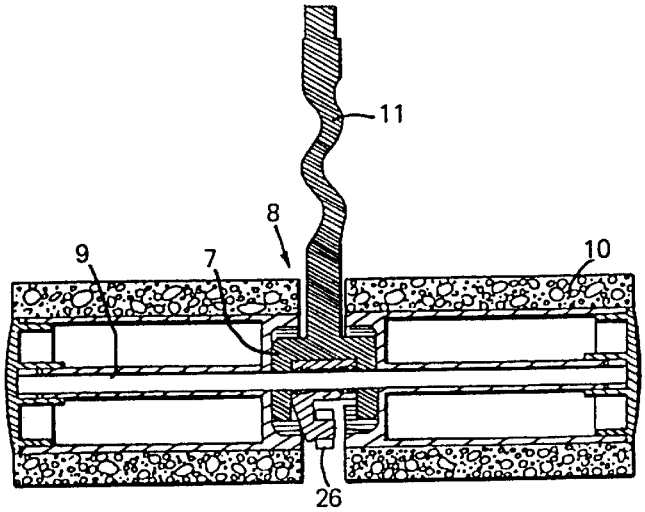
FIG. 6 is an axial cross-section of the roller unit of FIG. 3 taken on the line VI—VI of FIG. 5.

The first embodiment of the invention includes a roller unit, FIG. 2, comprising a roller 8 rotatably mounted on a handle 11, and a compression unit, FIG. 1, for removing and collecting liquid from the roller unit. Referring first to FIG. 2, the handle 11 of the roller unit carries a fixed transverse axle 9 at its lower end. The roller 8 comprises two roller sections 8' mounted on the axle 9 one on each side of the lower end of the handle 11. Each section 8' comprises a hollow cylindrical shell 14 of rigid plastics material rotatably mounted on the axle 9 by circular ball-bearing races 12, and each shell 14 is covered with a replaceable sleeve 10 of a highly absorbant sponge-like material such as cellulose or hydrophilic PVA foam. Between the inner end of each roller section 8' and the lower end of the handle 11 a respective further circular ball-bearing race 12, having further bearings 17 thereon, is rotatably mounted on the axle 9. Each further bearing 17 has an outside diameter less than that of the roller sections 8', and (as shown in FIG. 2) preferably less than that of the shells 14, for a purpose to be described.

The compression unit includes a flat perforated sheet 1 of steel, plastics or other suitable corrosion resistant material mounted over a container 2. The sheet 1 is preferably mounted non-horizontally over the container 2, most preferably at an angle of about 80 degrees to the horizontal. A downwardly sloping bar 3 is mounted over and substantially parallel to the upper surface of the sheet 1. The bar 3 is spaced from the upper surface of the sheet 1 by a distance which is slightly greater than the distance D shown on FIG. 2, i.e. the distance from the outside diameter of the shells 14 to the outside diameter of the bearings 17 on the diametrically opposite side of the axle 9. The container 2 is mounted on wheels 5 and has a handle 6 to facilitate use.

In use of the apparatus the handle 11 is used to roll the roller 8 of the roller unit back and forth over a floor or other surface from which water or other fluid is to be removed until the sleeves 10 are loaded with fluid. The roller 8 is than lifted and inserted between the bar 3 and the upper surface of the sheet 1 of the compression unit, FIG. 1. The roller is inserted such that the bar 3 engages one of the bearings 17.

Now, using the handle 11, the roller 8 is rolled up and down along the upper surface of the inclined sheet 1. During this motion the bar 3 is maintained in engagement with the bearing 7 by the handle 11 on one side and inner end of the shell 14 on the other side. Because the bar 3 is spaced from the upper surface of the sheet 1 by only slightly more than the distance D, FIG. 2, the bar 3 pushes the roller 8 against the surface of the sheet 1 to substantially fully compress the foam sleeves 10 where they contact the surface of the sheet 1, so that substantially all the fluid is expelled from the sleeves 10 after a few rotations of the roller 8. This leaves the roller 8 relatively free of water for the next operation.

The expelled fluid passes under gravity through the perforations in the sheet 1 for collection in the container 2. If desired, as shown in FIG. 1, a bucket 4 or the like can be placed in the container 2 to collect the expelled fluid, leaving the container 2 able to hold clean water for rinsing the roller and/or for rinsing or scrubbing the floor. It will be seen that the sheet 1 need not be perforated and that a channel can be provided at the bottom of the sheet so that water flowing down the sheet 1 can be directed into the container 2 or bucket 4.

In a modification (not shown) of the above embodiment the handle 11 may have a lower forked end which supports the axle 9 at each end, with a single roller section 8' being mounted on the axle 9 between the forked ends of the handle. In such a case the bearings 17 would be disposed at opposite ends of the roller section, and the compression unit would have two substantially parallel bars 3 spaced apart by the distance between the bearings 17 for engaging respective bearings 17.

A second embodiment of the invention will now be described with reference to FIGS. 3 to 9. In the second embodiment the roller unit, FIGS. 3 to 8, comprises a handle 11 whose lower end is formed to provide two parallel spaced-apart circular load bearings 17 joined by a semi-cylindrical bridge 20 which is connected to the handle 11. Each bearing 17 has a concentric hole 22 formed therein allowing a transverse axle 9 to rotate within the bearings 17.

The bridge 20 and bearings 17 form a housing for a catch mechanism 21. The catch mechanism 21 comprises a cylindrical body 23 which is located over the axle 9 between the bearings 17. The body 23 is formed of a metal and a pair of plastics bushings 24 are fitted into either end of the body 23 to provide for smooth rotation of the body on the axle 9. An arm 25 depends from one end of the body 23 and a small roller 26 is mounted on the end of the arm.

Figure 9:
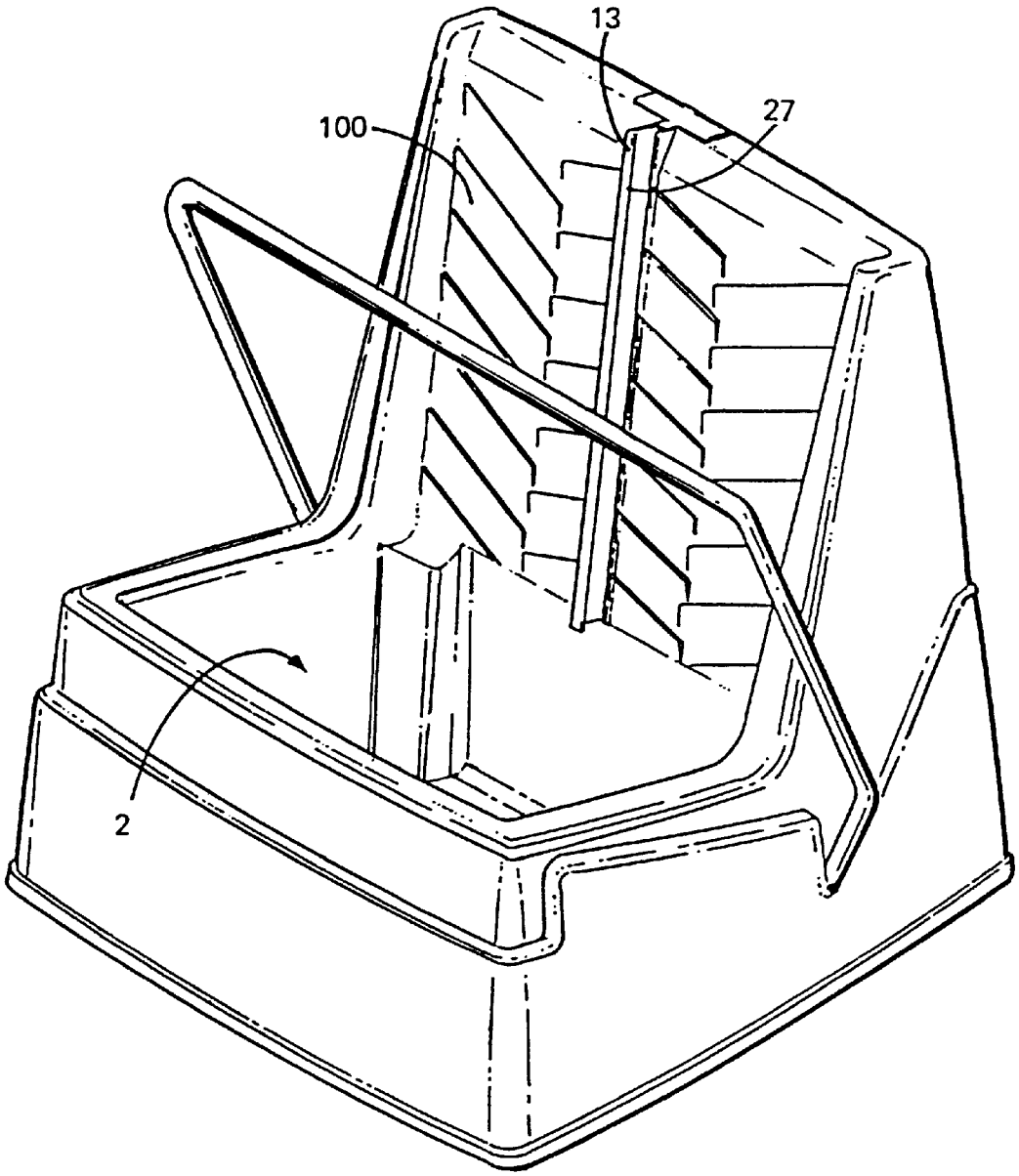
FIG. 9 is a perspective view of a compression unit of an apparatus according to a second embodiment of the invention, for use with the roller unit of FIGS. 3 to 8.
Figure 10:
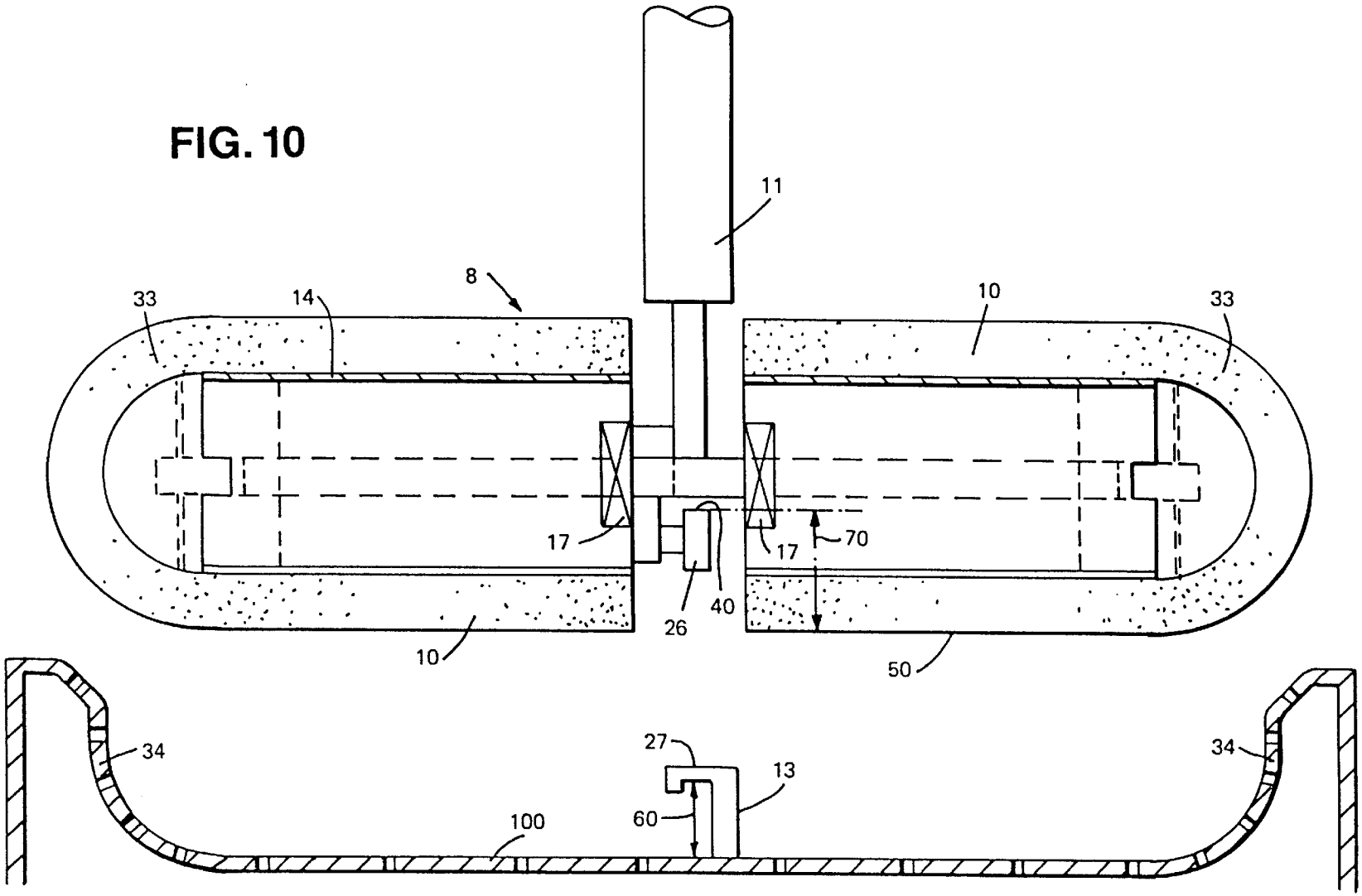
FIG. 10 is an axial cross-section of an apparatus according to a third embodiment of the invention.

In the second embodiment the compression unit, FIG. 9, comprises an integrally moulded plastics container 2 having a rail 13 extending downwardly along and, in cross-section, upstanding from a steeply inclined rear surface 100. The cross-section of the rail 13 is seen in the embodiment of FIG. 10, which uses a similar catch mechanism 21 and rail 13 to the present embodiment. The rail 13 has a transverse lip 27, more clearly seen in FIG. 10. The surface 100 formed at the rear of the container 2 replaces the inclined sheet 1 used in the first embodiment. The surface 100 does not have perforations allowing the water to pass through as did the sheet 1 in the first embodiment, but is formed with downwardly sloped channels, which direct the water into the container 2.

To expel liquid held in the foam sleeves 10, the roller 8 is located over the container 2 so that the small roller 26 engages under the lip 27, between the lip 27 and the surface 100. The distance 60, FIG. 10, of the lip 27 from the surface 100 is less than the distance 70 from the inside diameter 40 of the roller 26 to the outside diameter 50 of the uncompressed foam, FIG. 10. Thus, as the roller 8 is rolled up and down along the surface 100, the roller 8 is pulled towards the surface 100 causing the foam sleeves 10 to be compressed and liquid to be expelled and collected in the container 2.

It is preferable for the operator of the roller unit to be able to select whether the roller 8 is free to rotate around the axle 9 or not. To this end a pair of gravity-operated pawls 28 are pivotally mounted in respective bearings 17, FIG. 3. Each pawl 28 comprises a cylindrical stock 29 and a follower 30. Each stock 29 is located in a corresponding socket 32 in the side of a respective bearing 17. The ends of each of the roller shells 14 adjacent the bearings 17 are recessed and a circular set of teeth 31 is formed on each of their respective internal surfaces. The pawls 28 are free to rotate in their respective bearings 17 under gravity.

Figure 7:
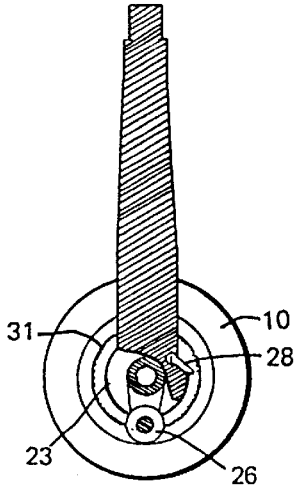
FIG. 7 is a transverse cross-section of the roller unit of FIG. 3 taken on the line VII—VII of FIG. 4.
Figure 8:
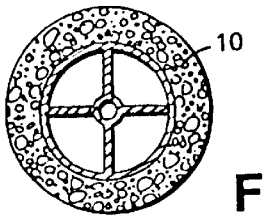
FIG. 8 is a transverse cross-section of the roller unit of FIG. 3 taken on the line V—V of FIG. 4.

In use of the roller unit with the roller axle 9 substantially horizontal, when the handle 11 is rotated to a position on the left hand side of the vertical, as seen in FIG. 7, the gravity pawls 28 will tend to pivot under gravity against their respective bearings 17 and away from engagement with the teeth 31. This allows the roller 8 to rotate continuously when the roller is both pushed and pulled by the operator so that the foam sleeves 10 absorb liquid.

However, by rotating the handle 11 to the right hand side of the vertical, as seen in FIG. 7, the pawls 28 fall away from their bearings 17 into engagement with the teeth 31. This prevents the roller 8 rotating relative to the handle 11 when the roller unit is pushed forwardly and allows a user to scrub a floor.

In a third embodiment, FIG. 10, each foam sleeve 10 is formed with a closed rounded end 33. The sides 34 of the surface 100 are correspondingly rounded with a slightly smaller radius of curvature so that the ends 33 of the sleeves may be squeezed when the roller 8 is pushed into the compression unit. This embodiment is particularly useful, for example, in cleaning car bodies, where damage to the surface from the ends of the rollers must be avoided.

The embodiments of the invention will leave the surface dryer than any non-electrical appliance known to the applicant including all types of squeegees and mops with wringing devices, etc.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for removing a liquid from a relatively non-absorbent hard surface comprising a roller unit including a roller rotatably mounted on a handle and covered with an absorbent material, and a compression unit into which the roller of the roller unit may be inserted for removing water from the roller by compressing the absorbant material, wherein the compression unit includes a surface along which the roller can be rolled and means engageable with the roller for pressing the roller against the surface to compress the absorbent material when the roller is rolled along the surface of the compression unit.

2. An apparatus as claimed in claim 1, wherein the means for pressing the roller against the surface includes at least one bar substantially parrallel to and spaced from the surface, the roller being insertable between the bar and the surface such that the bar pushes the roller against the surface when the roller is rolled along the surface.

3. An apparatus as claimed in claim 2, wherein the roller includes two roller sections covered with the absorbant material mounted on a common axle, and a bearing rotatable on the axle between the roller sections, the bearings having a lesser diameter than the roller sections and being engageable by the bar for pushing the roller against the surface.

4. An apparatus as claimed in claim 3, further including anti-rotation means on the roller unit for selectively preventing rotation of the roller relative to the handle.

5. An apparatus as claimed in claim 4, wherein the anti-rotation means comprises a gravity operated pawl mounted on the handle which cooperates with a circular set of teeth on the roller such that, with the roller axis substantially horizontal, when the handle is disposed on one side of the vertical the pawl engages the teeth to prevent rotation of the roller and when the handle is on the opposite side of the vertical the pawl disengages the teeth to permit rotation of the roller.

6. An apparatus as claimed in claim 2, further including anti-rotation means on the roller unit for selectively preventing rotation of the roller relative to the handle.

7. An apparatus as claimed in claim 6, wherein the anti-rotation means comprises a gravity operated pawl mounted on the handle which cooperates with a circular set of teeth on the roller such that, with the roller axis substantially horizontal, when the handle is disposed on one side of the vertical the pawl engages the teeth to prevent rotation of the roller and when the handle is on the opposite side of the vertical the pawl disengages the teeth to permit rotation of the roller.

8. An apparatus as claimed in claim 2, wherein the surface is mounted over a container for collecting liquid squeezed from the roller.

9. An apparatus as claimed in claim 3, wherein the surface is mounted over a container for collecting liquid squeezed from the roller.

10. An apparatus as claimed in claim 1, wherein the means for pressing the roller against the surface includes at least one rail extending along the surface, the roller having means engageable with the rail such that the rail pulls the roller against the surface when the roller is rolled along the surface.

11. An apparatus as claimed in claim 10, wherein the rail has a transverse lip and the roller has a dependent arm carrying a roller which can engage under the lip to pull the roller against the surface when the roller is rolled along the surface.

12. An apparatus as claimed in claim 11, further including anti-rotation means on the roller unit for selectively preventing rotation of the roller relative to the handle.

13. An apparatus as claimed in claim 12, wherein the anti-rotation means comprises a gravity operated pawl mounted on the handle which cooperates with a circular set of teeth on the roller such that, with the roller axis substantially horizontal, when the handle is disposed on one side of the vertical the pawl engages the teeth to prevent rotation of the roller and when the handle is on the opposite side of the vertical the pawl disengages the teeth to permit rotation of the roller.

14. An apparatus as claimed in claim 10, further including anti-rotation means on the roller unit for selectively preventing rotation of the roller relative to the handle.

15. An apparatus as claimed in claim 14, wherein the anti-rotation means comprises a gravity operated pawl mounted on the handle which cooperates with a circular set of teeth on the roller such that, with the roller axis substantially horizontal, when the handle is disposed on one side of the vertical the pawl engages the teeth to prevent rotation of the roller and when the handle is on the opposite side of the vertical the pawl disengages the teeth to permit rotation of the roller.

16. An apparatus as claimed in claim 10, wherein the surface is mounted over a container for collecting liquid squeezed from the roller.

17. An apparatus as claimed in claim 11, wherein the surface is mounted over a container for collecting liquid squeezed from the roller.

18. An apparatus as claimed in claim 1, further including anti-rotation means on the roller unit for selectively preventing rotation of the roller relative to the handle.

19. An apparatus as claimed in claim 18, wherein the anti-rotation means comprises a gravity operated pawl mounted on the handle which cooperates with a circular set of teeth on the roller such that, with the roller axis substantially horizontal, when the handle is disposed on one side of the vertical the pawl engages the teeth to prevent rotation of the roller and when the handle is on the opposite side of the vertical the pawl disengages the teeth to permit rotation of the roller.

20. An apparatus as claimed in claim 19, wherein the surface is mounted over a container for collecting liquid squeezed from the roller.

21. An apparatus as claimed in claim 18, wherein the surface is mounted over a container for collecting liquid squeezed from the roller.

22. An apparatus as claimed in claim 1, wherein the surface is mounted over a container for collecting liquid squeezed from the roller.

* * * * *